United States Patent [19]

Mancini et al.

[11] 4,328,032

[45] May 4, 1982

[54] TITANIUM AND NIOBIUM HIGH STRENGTH STEEL ALLOYS

[75] Inventors: Gerold A. Mancini, Rochester; George J. Dormer, Fairport, both of N.Y.

[73] Assignee: Sybron Corporation, Rochester, N.Y.

[21] Appl. No.: 129,970

[22] Filed: Mar. 13, 1980

[51] Int. Cl.[3] ..... C22C 38/04; C22C 38/06; C22C 38/08; C22C 38/14

[52] U.S. Cl. ..... 75/124; 75/123 K; 75/123 J; 75/123 N; 75/123 M; 148/12 C; 148/12 F

[58] Field of Search ..... 75/123 K, 123 N, 123 J, 75/123 M, 124 E, 123 L; 148/12 C, 12 F

[56] References Cited

U.S. PATENT DOCUMENTS 3,853,639 12/1974 Hughes ..... 148/12 C
3,857,740 12/1974 Gondo et al. ..... 148/12 F
3,928,083 12/1975 Gondo et al. ..... 148/12 C
3,976,514 8/1976 Matsukura et al. ..... 148/12 F
4,082,576 4/1978 Lake et al. ..... 148/12 F

*Primary Examiner*—W. Stallard
*Attorney, Agent, or Firm*—Theodore B. Roessel; Owen D. Marjama

[57] ABSTRACT

Steel alloys having improved mechanical properties and improved ambient and low temperature toughness following the repeated thermal exposures necessary to fuse and bond ceramic or glass coatings thereto have been prepared. Phase transformation temperatures are controlled by a critical combination of manganese, silicon, and optionally, nickel, in a steel alloy of silicon, carbon, aluminum, titanium and/or niobium, phosphorus, sulfur and iron. The resulting steel alloys have good glassability, and even after glassing demonstrate excellent yield strength, ultimate tensile strength and impact strength at both ambient and low temperatures (−20° F.).

6 Claims, No Drawings

TITANIUM AND NIOBIUM HIGH STRENGTH STEEL ALLOYS

BACKGROUND OF THE INVENTION

This invention relates to a high strength steel alloy, and more particularly, to a steel alloy which has improved mechanical properties (yield stength and ultimate tensile strength) and improved ambient and low temperature toughness (impact strength) following repeated thermal exposures which are related to applications of glass or enamel coatings thereto, and vitreous enamel-coated steel articles prepared therefrom. The alloys of the present invention are therefore particularly suited for use with coatings of vitreous enamels.

Steel alloys suitable for glassing not only must meet minimum standards for glassing prior to the glassing operation, but also must meet minimum mechanical and toughness standards after the glassing or enameling process which requires one or more elevated temperature exposures. Some of the prior art steel alloys have good mechanical and toughness properties after exposure to the heat necessary to glass the alloy, but they exhibit poor glassability. Other prior art steel alloys exhibit good glassing properties, but fail to meet the minimum mechanical and toughness standards required for a finished glassed steel product. Following the glassing operation which includes heating and cooling cycles for fusing of the glass coating material upon and to the steel substrates, it is desirable that the yield strength of the alloy at room temperature be at least about 30,000 psi, the ultimate tensile strength at room temperature be at least about 55,000 psi, and the Charpy "V" notch impact strength at −20° F. be at least about 15 ft. lbs. Furthermore, to assist in attaining these properties, the $Ac_3$ temperature (the completion of transformation on heating) should not exceed about 1600° F. and the $Ar_1$ temperature (the completion of transformation on cooling) should not extend below about 1200° F. These temperature ranges are necessary in order to take advantage of grain refinement in the steel during a glassing cycle which is equal to the time-temperature cycle required to normalize the steel.

There are many steel alloys available for "glassing", which is the application of at least one coating or layer of glass or ceramic (vitreous enamel) upon the surface of the steel. These alloys which are described in the prior art, generally have excellent mechanical properties and toughness prior to the thermal exposure necessary to fuse and bond ceramic or glass coatings to the steel substrate, however, following one or more of the glassing cycles, that is, the application of the coating material under conditions which raise the temperature of the steel as high as about 1650° F., the prior art steel alloys are characterized by numerous shortcomings and fail to meet the desired standards of one or all of these properties. In many cases there is a tendency of the glass coating to craze or crack during or after cooling the ceramic-metal composite from the firing temperature.

One of the major difficulties in enameling or coating of steel alloys with a vitreous or ceramic coating is the high transformation temperature of the alloys undergoing the coating. In U.S. Pat. No. 2,602,034 Eckel discloses a method of making enameling sheets from a slab of steel suitable for enameling stock. However, the alloy compositions disclosed by Eckel have low manganese content and no nickel, and accordingly, the Eckel alloy has a high transformation temperature and loses strength as a result of the thermal exposures accompanying the glassing operation, thereby resulting in a weakened steel substrate in the finished enameled product. Comstock et al in U.S. Pat. Nos. 2,495,835 and 2,495,836 disclose a steel alloy composition for vitreous enameling, the composition comprising, in general, below 1.0% titanium, not in excess of 0.15% carbon, not over 0.060% manganese, and not over 0.10% each of phosphorous, silicon, sulfur and the like. The alloys disclosed by Comstock et al are low in manganese, and nickel is only present in trace quantities. Accordingly, the alloy of Comstock et al has a high transformation temperature and fails to meet the desired strength requirements following repeated thermal exposure necessary for glassing the alloy.

In U.S. Pat. No. 2,303,064 Bernick et al disclose a titanium bearing steel alloy having vitreous enameling properties. The titanium must be present in the alloy in an amount at least four times that of the carbon, and by employing the titanium-containing steel of this type as a vitreous enameling base stock a single enamel covercoat of various kinds can be fused to the metal surface without the necessity of employing the usual ground coat thereto. A typical composition disclosed by Bernick et al is 0.045% carbon, 0.30% manganese, 0.01% phosphorus, 0.019% sulfur, 0.03% silicon, 0.018% aluminum and 0.34% titanium. However, the alloy in Bernick et al is low in manganese and contains no nickel. Accordingly, the Bernick et al alloy has a high transformation temperature and would not meet the minimum strength requirements after the thermal exposure necessary to apply the vitreous or ceramic coatings thereto. Titanium- and niobium-containing steel alloys are disclosed by Narita et al in the J. Iron and Steel Institute of Japan, 50, 43 (1964). The titanium-containing steel alloys of Narita et al consist of 0.14–0.39% titanium, 0.08–0.09% carbon, 0.28–0.31% silicon, 0.46–0.51% manganese, 0.006–0.009% phosphorus and 0.007% sulfur. The niobium-containing steel of Narita et al consists of 0.22–0.59% niobium, 0.08–0.09% carbon, 0.21–0.33% silicon, 0.48–0.51% manganese, 0.002–0.004% aluminum, 0.010–0.017% phosphorus and 0.007% sulfur. Although the alloy compositions of Narita et al exhibit a suitable strength before glassing, the strength of the steel following the thermal exposure necessary for the glassing technique would be too low to meet the desired values. The transformation temperature of the Narita et al alloy is too high to permit grain refinement during the exposure to heat. The alloy compositions of Narita et al do not contain nickel, and the manganese is sufficiently low so that the transformation temperatures of the alloys are high. The Narita et al alloy compositions are suitable for glassing, however, after the glassing operation, the yield strength and ultimate tensile strength are below the desired standards for applying glass or vitreous enamels to steels.

SUMMARY OF THE INVENTION

The novel alloy of this invention having improved mechanical and toughness properties after the thermal exposure required to coat said alloy with ceramic or glass coatings comprises a titanium and/or niobium, carbon, phosphorus, sulfur, aluminum, iron and a critical combination of manganese, silicon and optionally nickel, wherein the upper limit of the transformation range upon heating ($Ac_3$) is about 1600° F. and the lower limit of the transformation range upon coooling ($Ar_1$) is about 1200° F.

OBJECTS OF THE INVENTION

It is an object of this invention to provide a steel alloy having good glassability and having an improved yield strength, tensile strength and impact strength after subjecting the steel substrate to at least one thermal exposure necessary to fuse and bond a ceramic or glass coating thereto.

It is another object of this invention to provide a steel article coated with a glass or ceramic coating by a method which encompasses at least one exposure of the steel substrate to high temperatures.

Another object of this invention is to provide a steel alloy suitable for the application of a glass or ceramic coating thereto having an $Ac_3$ temperature (the completion of transformation on heating) not exceeding about 1600° F. and an $Ar_1$ temperature (the completion of the transformation on cooling) not extending below about 1200° F.

These and other objects and advantages of this invention will become apparent upon consideration of the following detailed description, and the novel features thereof will be particularly pointed out hereinafter in connection with the appended claims.

DETAILED DESCRIPTION OF THE INVENTION

According to this invention improved mechanical and toughness properties for ceramic coated steel are achieved over other titanium and/or niobium bearing carbon steels after the ceramic coating process by controlling the phase transformation temperatures of the alloy upon heating and cooling through combination alloying with manganese, silicon and optionally nickel, in a steel alloy of manganese, silicon, carbon, aluminum, titanium and/or niobium, phosphorus, sulfur, optionally nickel, and the balance iron. The proper alloying determines the temperature range of the transformation temperatures upon heating, which yields grain refinement due to the allotropic transformation of the steel. This temperature transformation range is controlled, through alloying, to occur just below the uppermost temperature required to mature the ceramic coatings so that advantage is taken of the grain refinement which occurs as a result of passing through the transformation temperature range ($Ac_1$ to $Ac_3$) upon heating. It was also determined that heating and holding below the $Ac_1$ temperature on conventional titanium bearing enameling steels resulted in excessive grain growth, which drastically reduces the strength and toughness of such steels. The combination of alloying according to this invention further provides strengthening through solid solution strengthening and some increment of strength due to dispersion strengthening by TiC and TiN and possibly titanium carbo-nitrides. Impact strength or toughness at low temperature (−20° F.) is enhanced by control of the grain size and combination alloying with manganese, silicon and aluminum. The addition of nickel in combination with manganese, silicon and aluminum also improves the tensile strength and impact properties.

The combination alloying must be balanced so that the transformation temperature range upon cooling ($Ar_3$ to $Ar_1$) is such that it will not cause cracking or crazing of the ceramic coatings or drastically reduce the thermal shock characteristic of the composite. Also, the combination alloying elements must be controlled so that decomposition products of the austenite which degrade the toughness or impact strength, will not form.

The ranges in weight percent of the alloying elements are given below:

Manganese—0.40–3.00
Silicon—0.10–1.80
Nickel—0.01–2.50
Aluminum—0.002–0.60
Carbon—0.03–0.50
Titanium—0.04–2.0
Niobium—0.30–1.00
Phosphorus—0.04 max
Sulfur—0.04 max
Iron—Balance Niobium bearing alloys in combination with nickel and niobium bearing alloys in combination with titanium and nickel also showed improved strength properties. The preferred composition of the present alloy steel in weight percent comprises about 0.4 to 3.0% manganese, about 0.1 to 1.8% silicon, up to 2.5% nickel, about 0.002 to 0.6% aluminum, about 0.03 to 0.5% carbon, up to about 0.04% phosphorus, up to about 0.04% sulfur, a metal selected from a group consisting of about 0.04–2.0% titanium and about 0.3–1.0% niobium and mixtures thereof with said mixtures containing at least that amount of titanium and niobium required to stabilize the carbon in the alloy, with the balance of the alloy comprising iron. Further, the concentration of the nickel should be maintained from 0.0% to trace quantities when the concentration of manganese is at least about 2.0% with concentration of silicon being no greater than about 0.4%, and the concentration of nickel being about 1.2–2.5% when the concentration of manganese and nickel combined is about 2.9% or less, with concentration of manganese being no less than about 0.7%.

A variation of the preferred composition provides for the concentration of nickel to be maintained above 1.2% when the concentration of nickel and manganese combined is about 3.1% or less, and the concentration of manganese is no greater than about 1.9%, and with the concentration of aluminum being about 0.5% when the concentration of aluminum and silicon combined is about 0.7–0.9%.

A second preferred composition in weight percent having particular use for glass lined pressure vessels is as follows:

Carbon—0.03 to 0.12
Manganese—1.45 to 1.90
Phosphorus—up to 0.040
Sulfur—up to 0.040
Silicon—0.15–0.35
Nickel—1.20–1.45
Aluminum—0.30–0.60
Titanium, minimum—at least 4×Carbon Content
Iron—Balance Other modifications and ramifications of the present invention would appear to those skilled in the art upon reading this disclosure. These are also intended to be within the scope of this invention.

What is claimed is:

1. A steel alloy consisting essentially in weight percent of about 0.4 to 3.0% manganese, about 0.1 to 1.8% silicon, up to about 2.5% nickel, about 0.002 to 0.6% aluminum, about 0.03 to 0.5% carbon, up to about 0.04% phosphorus, up to about 0.04% sulfur and a metal selected from the group consisting essentially of about 0.04 to 2.0% titanium about 0.3 to 1.0% niobium and mixtures thereof, said mixtures thereof consisting of at least that amount of titanium and niobium to stabilize the carbon in the alloy, and the balance iron, with concentration of the nickel being up to trace quantities when the concentration of manganese is at least about 2.0% with the concentration of the silicon being no greater than about 0.4%, and the concentration of the nickel being about 1.2% to 2.5% when the concentration of the manganese and nickel combined is about 2.9% or less, with the concentration of the manganese being no less than about 0.7%.

2. The alloy in accordance with claim 1 wherein the upper limit of the transformation range upon heating ($Ac_3$) is about 1600° F.

3. The alloy in accordance with claim 1 wherein the lower limit of the transformation range upon cooling ($Ar_1$) is about 1200° F.

4. An alloy in accordance with claim 1 wherein the concentration of nickel is above 1.2% when the concentration of nickel and manganese combined is about 3.1% or less and the concentration of manganese is no greater than about 1.9%, and the concentration of aluminum is about 0.5% when the concentration of aluminum and silicon combined is about 0.7% to 0.9%.

5. The alloy of claim 1 having at least one coating of a vitreous or ceramic enamel.

6. An alloy which consists essentially of the following composition:

| Element | Wt. % |
|---|---|
| Carbon | 0.03 to 0.12 |
| Manganese | 1.45 to 1.90 |
| Phosphorus | up to 0.040 |
| Sulfur | up to 0.040 |
| Silicon | 0.15–0.35 |
| Nickel | 1.20–1.45 |
| Aluminum | 0.30–0.60 |
| Titanium, minimum | at least 4× Carbon Content |
| Iron | Balance |

* * * * *